US009861200B2

(12) United States Patent
Lim

(10) Patent No.: US 9,861,200 B2
(45) Date of Patent: Jan. 9, 2018

(54) SLIDING RAILS FOR MOUNTING SHELF

(71) Applicant: DUDU WORLD. CO., LTD., Seongnam-si, Gyeonggi-do (KR)

(72) Inventor: Gisun Lim, Seongnam-si (KR)

(73) Assignee: DUDU WORLD. CO., LTD., Seongnam-si (KR)

( * ) Notice: Subject to any disclaimer, the term of this patent is extended or adjusted under 35 U.S.C. 154(b) by 79 days.

(21) Appl. No.: 15/092,325

(22) Filed: Apr. 6, 2016

(65) Prior Publication Data

US 2016/0345730 A1 Dec. 1, 2016

(30) Foreign Application Priority Data

May 26, 2015 (KR) ..... 10-2015-0072998

(51) Int. Cl.

| | |
|---|---|
| ***A47B 88/04*** | (2006.01) |
| ***A47B 96/07*** | (2006.01) |
| ***A47B 88/483*** | (2017.01) |
| *A47B 88/40* | (2017.01) |

(52) U.S. Cl.

CPC ..... *A47B 96/07* (2013.01); *A47B 88/483* (2017.01); *A47B 2088/401* (2017.01)

(58) Field of Classification Search

CPC . A47B 88/483; A47B 2088/401; A47B 96/07; A47B 88/423; A47B 88/4235; A47B 88/49

See application file for complete search history.

(56) References Cited

U.S. PATENT DOCUMENTS

| | | | | | |
|---|---|---|---|---|---|
| 4,241,668 | A * | 12/1980 | Carroll | A47B 31/00 | 108/26 |
| 4,597,616 | A * | 7/1986 | Trubiano | A61G 12/00 | 211/113 |
| 4,673,089 | A * | 6/1987 | Chap | A47G 23/0208 | 211/119 |
| 4,735,470 | A * | 4/1988 | Falk | A47B 77/16 | 312/246 |
| 4,792,195 | A * | 12/1988 | Adriaansen | A47B 88/407 | 248/201 |
| 5,036,990 | A * | 8/1991 | Verchere | A47B 77/16 | 211/113 |
| 6,578,720 | B1 * | 6/2003 | Wang | A47F 5/0093 | 211/126.15 |
| 6,799,817 | B1 * | 10/2004 | Chu | A47B 88/467 | 312/330.1 |
| 6,926,377 | B2 * | 8/2005 | Lammens | A47B 88/49 | 312/333 |
| 7,357,468 | B2 * | 4/2008 | Hwang | A47B 88/49 | 312/333 |
| 8,132,875 | B2 * | 3/2012 | Juang | A47B 88/49 | 312/333 |
| 8,162,420 | B2 * | 4/2012 | Chen | A47B 88/423 | 312/334.1 |

(Continued)

FOREIGN PATENT DOCUMENTS

KR 10-0813330 B1 3/2008

*Primary Examiner* — Bradley Duckworth

(74) *Attorney, Agent, or Firm* — Novick, Kim & Lee, PLLC; Jae Youn Kim

(57) ABSTRACT

Provided is a sliding rail for mounting a shelf, which is mounted on a shelf for displaying things of various kinds and is simply regulated in length according to thickness and width of the shelf, thereby improving convenience in use.

5 Claims, 10 Drawing Sheets

(56) References Cited

U.S. PATENT DOCUMENTS

| | | | | |
|---|---|---|---|---|
| 8,408,666 | B2 * | 4/2013 | Armstrong | A47B 88/407 312/408 |
| 9,596,931 | B1 * | 3/2017 | Nimgulkar | A47B 88/08 |
| 2005/0074190 | A1 * | 4/2005 | Traiser | A47B 88/483 384/21 |
| 2006/0113443 | A1 * | 6/2006 | Remmers | A47B 57/42 248/235 |
| 2008/0018213 | A1 * | 1/2008 | Chen | A47B 88/423 312/334.4 |
| 2008/0074021 | A1 * | 3/2008 | Croft | A47B 96/025 312/334.1 |
| 2011/0262060 | A1 * | 10/2011 | Yu | A47B 88/49 384/21 |
| 2012/0146476 | A1 * | 6/2012 | Tibbe | A47B 88/42 312/334.8 |
| 2016/0270532 | A1 * | 9/2016 | Gleixner | A47L 15/507 |
| 2017/0086584 | A1 * | 3/2017 | Rehage | F25D 25/025 |
| 2017/0160000 | A1 * | 6/2017 | Haltmeyer | F25D 23/067 |

* cited by examiner

SLIDING RAILS FOR MOUNTING SHELF

CROSS-REFERENCE TO RELATED APPLICATIONS

The present application claims benefit of priority under 35 U.S.C. §119 and 37 C.F.R. §1.55 to Korean patent application No. 10-2015-0072998 filed on May 26, 2015, the entire contents of which is hereby incorporated by reference.

TECHNICAL FIELD

The present invention relates to sliding rails for mounting a shelf, and more particularly, to sliding rails for mounting a shelf, each of which is mounted on a shelf for displaying things of various kinds and is simply regulated in length according to thickness and width of the shelf, thereby improving convenience in use.

BACKGROUND ART

In general, houses or offices are furnished with a lot of furniture, and, out of the furniture, cabinets for storing goods are equipped with a plurality of drawers for storing things therein.

Each of the drawers has sliding rails mounted at both sides thereof so that a user can easily classify and keep various clothes, toys or other articles and easily take and use the things out of the drawer.

As disclosed in Korean Patent No. 10-0813330, such sliding rails are mounted on desks, wardrobes, sinks, office furniture, or drawer-type refrigerators so as to make the drawer move in and out smoothly when the user opens or closes the drawer.

Now, the basic structure of the sliding rail 1 will be described in brief. The sliding rail includes: fixed rails 2 respectively fixed on both side wall of the wardrobe in which drawers are mounted; auxiliary rails 3 respectively assembled to the inside of the fixed rails 2 to be movable in forward and backward directions; movable rails 4 which are respectively assembled inside the auxiliary rails 3 to be movable in the forward and backward directions and are respectively fixed on both side walls of a tray; and liner bearings 5 respectively mounted among the fixed rails 4, the auxiliary rails 3 and the movable rails 4.

Moreover, such sliding rails 1 are divided into a two-stage rail, which is mainly applied to a drawer subject to less load of stored things and includes a fixed rail 2 fixed on the side wall of a wardrobe and a movable rail 4 attached to the drawer, and a three-stage rail, which is mainly applied to a drawer subject to lots of load and includes a fixed rail 2 fixed on the side wall of a wardrobe, a movable rail 4 attached to the drawer and an auxiliary rail 3 mounted between the fixed rail 2 and the movable rail 4.

In the meantime, recently, such sliding rails are mounted on shelves for displaying various kinds of things such that the user can use the things stored in a storage tray by moving the storage tray, in which various things are stored, in the forward and backward directions along the sliding rails.

However, because the tray moves along the rails, if the user applies power to the tray in order to withdraw or insert the drawer, shock is applied to the shelf on which the sliding rails are fixed and the shelf may be damaged or the sliding rails are separated from the shelf when the user makes frequently use of the shelf.

Therefore, a shock absorber is attached to the sliding rail in order to prevent shock from being transmitted to the shelf.

Additionally, when shock is applied to the rails after the drawer is withdrawn or inserted, the rails are separated from each other. So, the sliding rail has inconvenience that the user has to reassemble the rails.

Furthermore, recently, for beauty of wardrobes and shelves, the wardrobes and shelves are not made with wood but made with glass or metal, but the storage tray is removed because it is inconvenient to mount the sliding rails on the wardrobe or the shelf made with glass or metal. However, for wanting of storage spaces, people demand sliding rails which are capable of being mounted even on shelves made with glass or metal.

In addition, because the sliding rails standardized in size are manufactured but shelves have various sizes and thicknesses, it is difficult to mount the sliding rails on the shelves.

DISCLOSURE

Technical Problem

Accordingly, the present invention has been made in an effort to solve the above-mentioned problems occurring in the prior arts, and it is an object of the present invention to provide sliding rails for mounting a shelf, each of which is regulated in length according to the size and thickness of the shelf regardless of materials of the shelf so as to be simply mounted on the shelf.

It is another object of the present invention to provide sliding rails for mounting a shelf which are capable of being inserted in a state where the stopper is released when the sliding rails are regulated in length and which are slidably moved without any restriction to be withdrawn, thereby enhancing convenience in use.

Technical Solution

To achieve the above objects, the present invention provides sliding rails for mounting a shelf, which make a pair to withdraw or insert a storage tray, and each of which is regulated in length according to the size of the shelf, the sliding rail including: a fixed rail which includes a first concave-convex part formed at the rear of the drawing, an elongated guide hole formed in the side in the longitudinal direction, a rack extending on an upper portion of an inner wall of the guide hole in the longitudinal direction, and a rail support bent at a lower portion of the inner wall; a control rail which includes a second concave-convex part formed at the front which is in the opposite direction to the first concave-convex part, and a tray support formed in such a way that the storage tray is put on the lower end of the inner wall while the lower portion is seated on the rail support; a stopper located outside the guide hole, the stopper including a retaining plate which is formed at one end portion and has a through hole, a guide bush which protrudes from the inner face of the retaining plate and is fit into the guide hole, a pressing plate formed at the other end portion, and a pawl which is formed on the inner face of the pressing plate and engages with the rack of the upper portion of the inner wall after passing through the guide hole; a fastening member which is screw-coupled to the side wall of the control rail after passing through the through hole and the guide hole from the outside of the stopper to fix the pressing plate to be elastically moved in the right and left directions inside the guide hole while the guide bush of the stopper moves along the guide hole; and hook means including a third concave-convex part continuously formed on the inner face, which is opposed to the first and second concave-convex parts, in the height direction and a retaining hook bent at the upper portion in the direction of the shelf so that the hook means is mounted when the retaining hook is caught to front end portions of the front and rear sides of the shelf while being concave-convexly combined to the fixed rail and the control rail.

Moreover, the hook means includes: a bottom plate which is formed in a plate type and is located below the fixed rail from one end portion to the other end portion; a middle plate which is continuously bent to surround the front side of the second concave-convex part and the thickness of the shelf; and a hook plate which is formed in such a way that the middle plate is bent to be longer than a withdrawn length of the control rail and to be bridged above the front side of the shelf.

Furthermore, the first, second and third concave-convex parts respectively have separation preventing jaws respectively protruding from lower portions and upper portions of the convex-shaped front ends thereof to engage with each other so that the hook means having the third concave-convex part is combined by horizontally moving from the outside of the first and second concave-convex parts of the fixed rail and the control rail.

Additionally, the third concave-convex part is formed inclinedly in such a way that concave surfaces and convex surfaces are formed at equal intervals at both end portions but an interval between concave surfaces is smaller than that between convex surfaces in the middle of the third concave-convex part.

Moreover, a pair of the sliding rails are mutually symmetric in the opposite direction to each other, and an interval maintaining bar is mounted on the opposed faces of the control rail.

Furthermore, the fixed rail further includes a separation preventing member joined to the lower portion of the outer face thereof and the bottom plate has a separation preventing piece bent upwardly from the outside of the bottom plate so that the plate-type hook means moves in the forward and backward direction together with the control rail while the separation preventing piece is located between the outside of the fixed rail and the separation preventing member.

In addition, the hook means which has a retaining hook located downwardly is concave-convexly combined to the rear side of the fixed rail and is fastened to the wall surface of furniture by a fixing piece penetrating the third concave-convex part located outside the lower portion of the fixed rail.

Advantageous Effects

As described above, the sliding rails according to the present invention can be easily mounted on a shelf made with glass or metal without any fixing work such that the user can withdraw or insert the storage tray to use the storage tray as a storage space.

Moreover, the sliding rails according to the present invention can be mounted even in the state where both sides of the shelf are open or only one side of the shelf is open so as to make better use of a space such that the user can easily store or take out the stored things, thereby increasing productivity.

MODE FOR INVENTION

Figure 1:
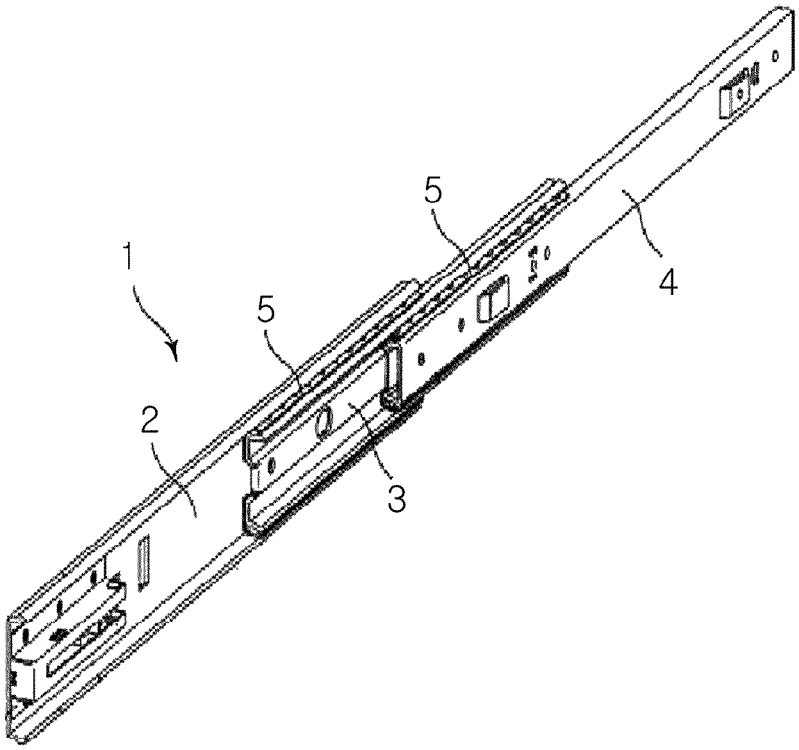
FIG. 1 is a perspective view of a conventional sliding rail.

Reference will be now made in detail to the preferred embodiment of the present invention with reference to the attached drawings.

First, sliding rails for mounting a shelf according to the present invention are mounted on a shelf for displaying things of various kinds and are simply regulated in length according to thickness and width of the shelf, thereby improving convenience in use.

In the present invention, a pair of sliding rails are provided in a set. One sliding rail is described in the present invention, and the other sliding rail has the same structure as the former sliding rail but the two sliding rails are formed to symmetrically face each other.

As shown in FIGS. 2 to 5B, the sliding rail 100 includes: a fixed rail 10 and a control rail 20 regulated in length according to the length of a shelf 6; a stopper and a fastening member 40 for restricting movement of the control rail 20; and hook means which are assembled to the fixed rail 10 and the control rail 20 regulated in length and are mounted on the shelf 6.

Figure 2:
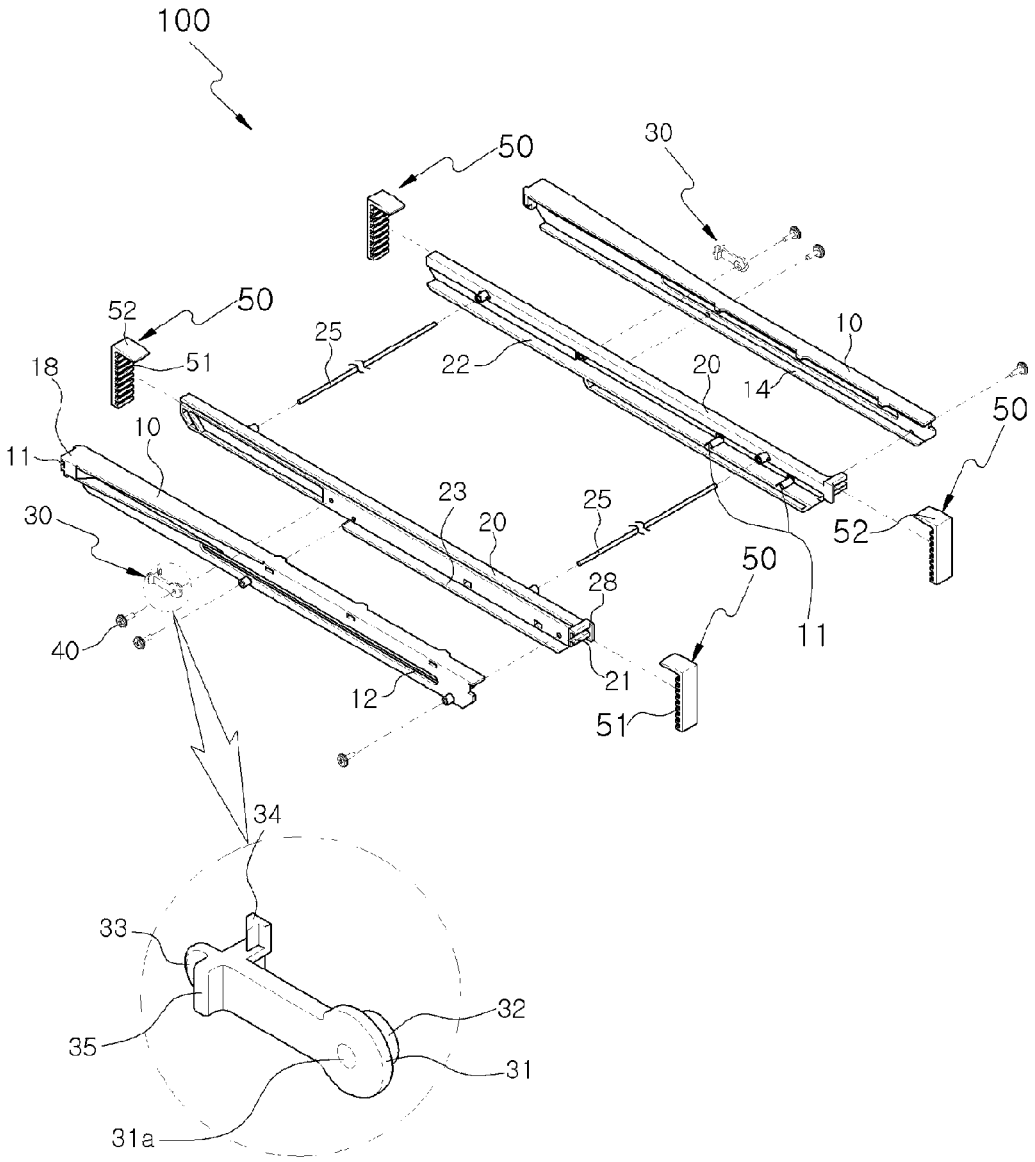
FIG. 2 is an exploded perspective view of a sliding rail for mounting a shelf according to a first preferred embodiment of the present invention.
Figure 3:
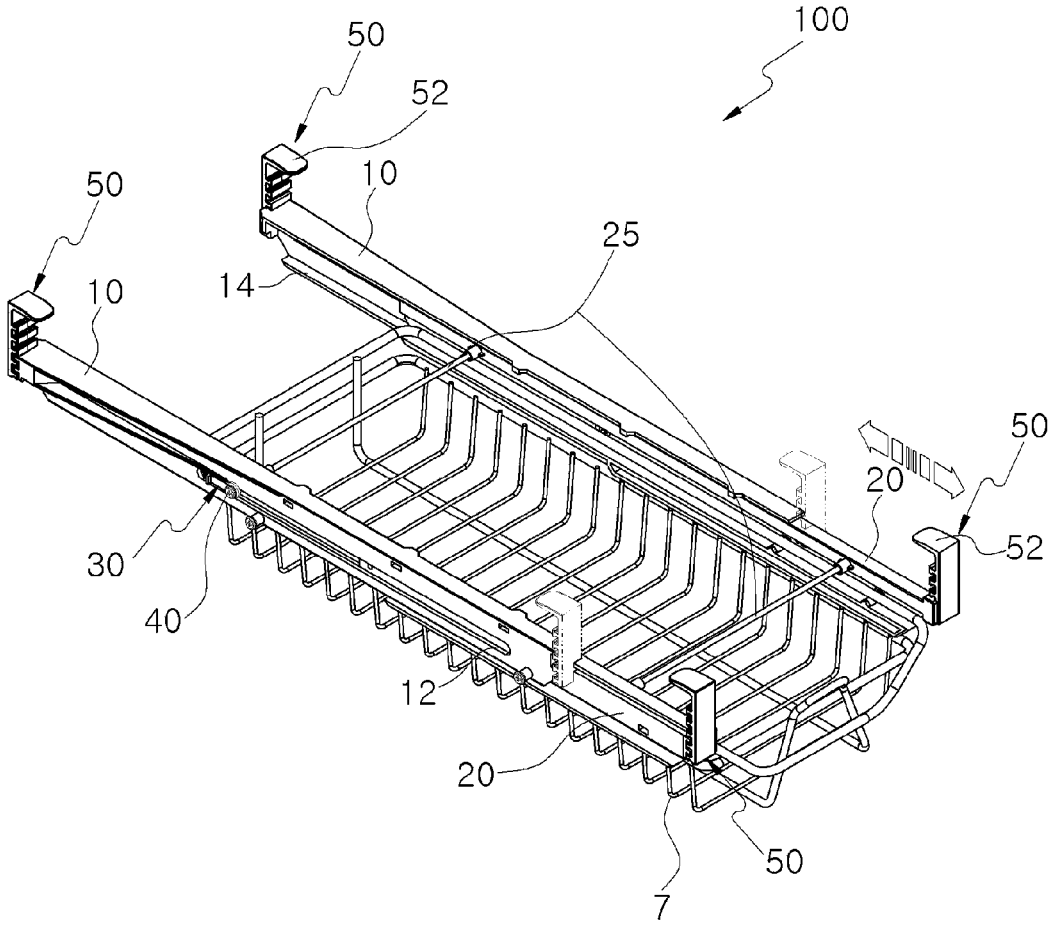
FIG. 3 is a perspective view of the sliding rail according to the present invention.

Moreover, referring to FIGS. 2 to 4, a direction standard used in the present invention will be described in brief. The sliding rail 100 is mounted beneath the shelf (not shown) through the hook means 50. In the drawings, when the control rail 20 is withdrawn in the right direction or inserted in the left direction according to the length of the shelf in the state where the sliding rail 100 is fixed on the shelf in the left of the drawings, the fixed rail 10 is regulated in length.

The fixed rail 10 includes: a first concave-convex part 11 formed at the rear of the drawing; an elongated guide hole 12 formed in the side in the longitudinal direction; a rack 13 extending on an upper portion of an inner wall of the guide hole 12 in the longitudinal direction; and a rail support 14 bent at a lower portion of the inner wall.

The rack 13 is formed in a saw-toothed ratchet shape, is capable of freely moving in one direction, and is selectively move in the opposite direction according to restriction of a pawl which will be described later.

The control rail 20 includes: a second concave-convex part 21 formed at the front of the drawing, which is in the opposite direction to the first concave-convex part 11; and a tray support 22 which is bent so that a storage tray 7 for storing various things in the lower end of the inner wall can be withdrawn or inserted while the lower portion is seated on the rail support 14 of the fixed rail 10.

The tray support 22 has a stopper protrusion 27 for preventing the storage tray 7 from being withdrawn too much to be separated from the shelf or inserted so much that shock is applied thereto.

Moreover, like the rail support 14 formed at the lower portion of the inner wall of the fixed rail 10, a protruding support is formed at the upper portion. The control rail 20 is located between the supports so as to move in a straight line when being withdrawn or inserted.

Furthermore, the tray support 22 of the control rail 20 which is seated on the rail support 14 of the fixed rail 10 is continuously bent to surround the rail support 14 while the end portion extends downwardly such that a lower guide rail 23 is formed. The rail support 14 is located inside the lower guide rail 23, and then, moves straightly along the rail support 14 when the control rail 20 moves to be withdrawn or inserted.

Additionally, a stopper 30 which is located outside the guide hole 12 of the fixed rail 10 and fixed on the outer wall of the control rail 20 by the fastening member 40 includes: a retaining plate 31 formed at the front of the drawing and having a through hole 31*a* through which the fastening member 40 passes; and a pressing plate 33 formed integrally with the stopper 30 at the rear of the drawing to elastically move in the direction of the guide hole 12.

In addition, the stopper 30 further includes: a guide bush 32 which protrudes from the inner face of the retaining plate 31 and is fit into the guide hole 12 while the retaining plate 31 is caught to the outer face of the guide hole 12 of the fixed rail 10; and a saw-toothed pawl 34 formed integrally with the inner face of the pressing plate 33 and engages with the rack 13 of the upper portion of the inner face of the fixed rail 10 after passing through the guide hole 12.

Therefore, when the stopper 30 is screw-coupled to the outer wall of the side of the control rail 20 using the fastening member 40 and the control rail 20 is withdrawn or inserted, the guide bush 32 of the stopper 30 is moved along the guide hole 12. Only when the control rail is inserted, the pressing plate 33 is pressed in the inward direction of the guide hole 12 and the pawl 34 engaging with the rack 13 is moved to release the restriction so that the control rail 20 can be withdrawn or inserted.

Moreover, the hook means 50 joined to the rear side of the fixed rail 10 and the front side of the control rail 20 includes: a third concave-convex part 51 formed on the inner face in the height direction; and a retaining hook 52 formed at the upper portion to be bent in the direction of the shelf 6. The hook means 50 is mounted when the retaining hook 52 is concave-convexly combined to the first and second concave-convex parts 11 and 12 of the fixed rail 10 and the control rail 20 and is caught to the front and rear end portions of the shelf 6.

Now, a preferred embodiment of the present invention having the above structure will be described. As shown in FIGS. 3 and 4, the control rail 20 is seated on the rail support 14 of the inner wall of the fixed rail 10. After that, the stopper 30 is located outside the guide hole 12 of the fixed rail 10, and then, is fastened and fixed to the outer wall of the control rail 20 using the fastening member 40.

In this instance, because the rail support 14 protrudes from the upper portion and the lower portion of the inner wall of the fixed rail 10, the rail support 14 guides the control rail 20 to move in the direction to be withdrawn forwardly or inserted backwardly so as to prevent separation of the control rail 20.

Furthermore, the stopper 30 located outside the fixed rail 10 has the retaining plate 31 which is larger than the guide hole 12, and is fixed when the fastening member 40 passes through the through hole 31*a* and the guide hole 12 and is fastened to the control rail 20 in the state where the guide bush 32 disposed inside the retaining plate 31 is fit to the guide hole 12.

Figure 5A:
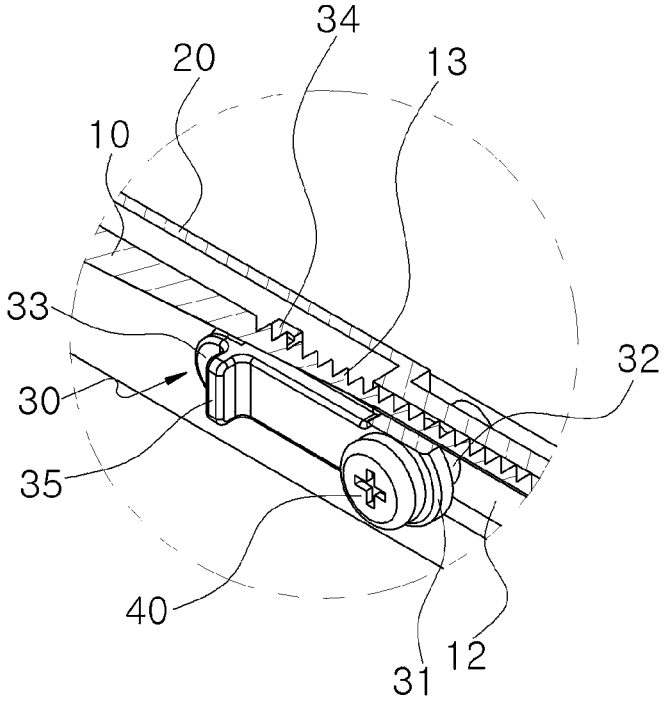
FIG. 5A is a sectional view showing an initial state of a stopper of the sliding rail.

Additionally, as shown in FIG. 5A, the stopper 30 keeps the state where the pawl 34 extending from the inner face of the pressing plate 33 engages with one saw of the rack 13 continuously formed on the inner face of the fixed rail 10 in the initial state that the pressing plate 33 which extends from the retaining plate 31 and is formed integrally with the retaining plate 31 is spaced apart from the outside of the guide hole 12.

The rack 13 of the fixed rail 10 and the pawl 34 of the pressing plate 33 are formed in the saw-toothed ratchet shape and engage with each other so as to freely move only in one direction. Therefore, a user can easily pull the control rail 20 in the direction to withdraw in the initial state. However, when the user tries to push the control rail 20 in the insertion direction, movement of the control rail 20 is restricted because the saw-toothed rack 13 is caught to the pawl 34.

Figure 5B:
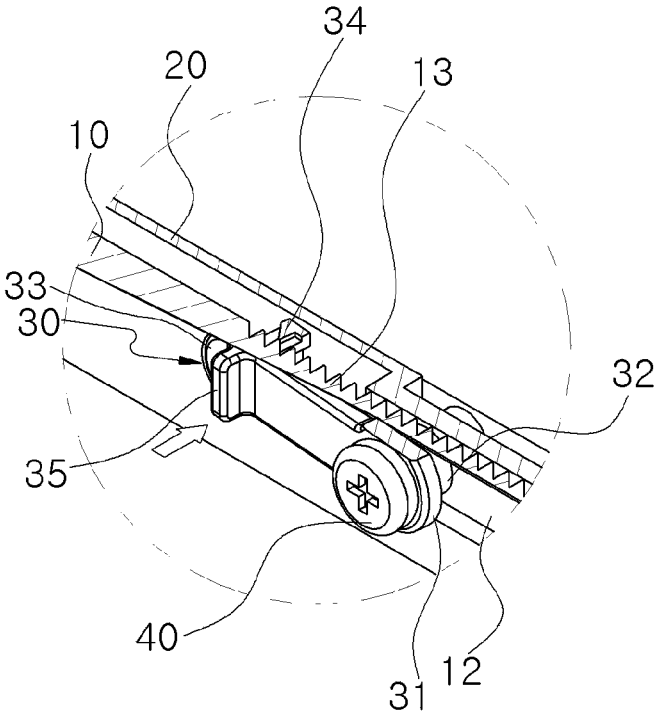
FIG. 5B is a sectional view showing a state that the sliding rail is released from restriction.

Therefore, as shown in FIG. 5B, in order to insert the control rail 20, the user presses the pressing plate 33 in the direction of the guide hole 12 such that the pawl 34 engaging with the saw-toothed rack 13 is pushed to be separated from the rack 13. So, the restriction on insertion movement of the control rail 20 is released.

In this instance, the stopper 30 further includes a pressing protrusion 35 which extends from the retaining plate 31 and outwardly protrudes from an end of the pressing plate 33 having self-elasticity so that the user can easily move the pressing plate 33 and the pawl 34 by pressing the pressing protrusion 35 with lesser power.

Moreover, when the user removes the power applied to the pressing plate 33 after regulating the length of the control rail 20 by withdrawing or inserting the control rail 20 according to the length of the shelf 6, the pressing plate 33 returns to its initial state by self-elasticity and the pawl 34 engages with one tooth of the rack 13 so that the control rail 20 is fixed in the restricted state.

Furthermore, the hook means 50 which has the third concave-convex part 51 continuously formed in the height direction is combined to the first concave-convex part 11 of the rear side of the fixed rail 10 and the second concave-convex part 21 of the front side of the control rail 20, and then, the retaining hook 52 which is bent from the upper portion of the hook means 50 toward the shelf is caught to both end portions of the front and rear sides of the shelf 6 such that the sliding rail 10 is mounted.

Here, the concave-convex combination has been widely used to fit a concave surface to a convex surface to be combined with each other. However, in the present invention, the third concave-convex part 51 is formed inclinedly in such a way that concave surfaces and convex surfaces are formed at equal intervals at both end portions but an interval between concave surfaces is smaller than that between convex surfaces in the middle of the third concave-convex part 51.

Therefore, when the third concave-convex part 51 of the hook means 50 is combined to the first and second concave-convex parts 11 and 21 of the fixed rail 10 and the control rail 20, the convex surfaces of the first and second concave-convex parts 11 and 21 are forcedly fit to the smaller concave surface in the middle of the third concave-convex part 51 so as to prevent the hook means 50 from moving and being easily separated.

Figure 4:
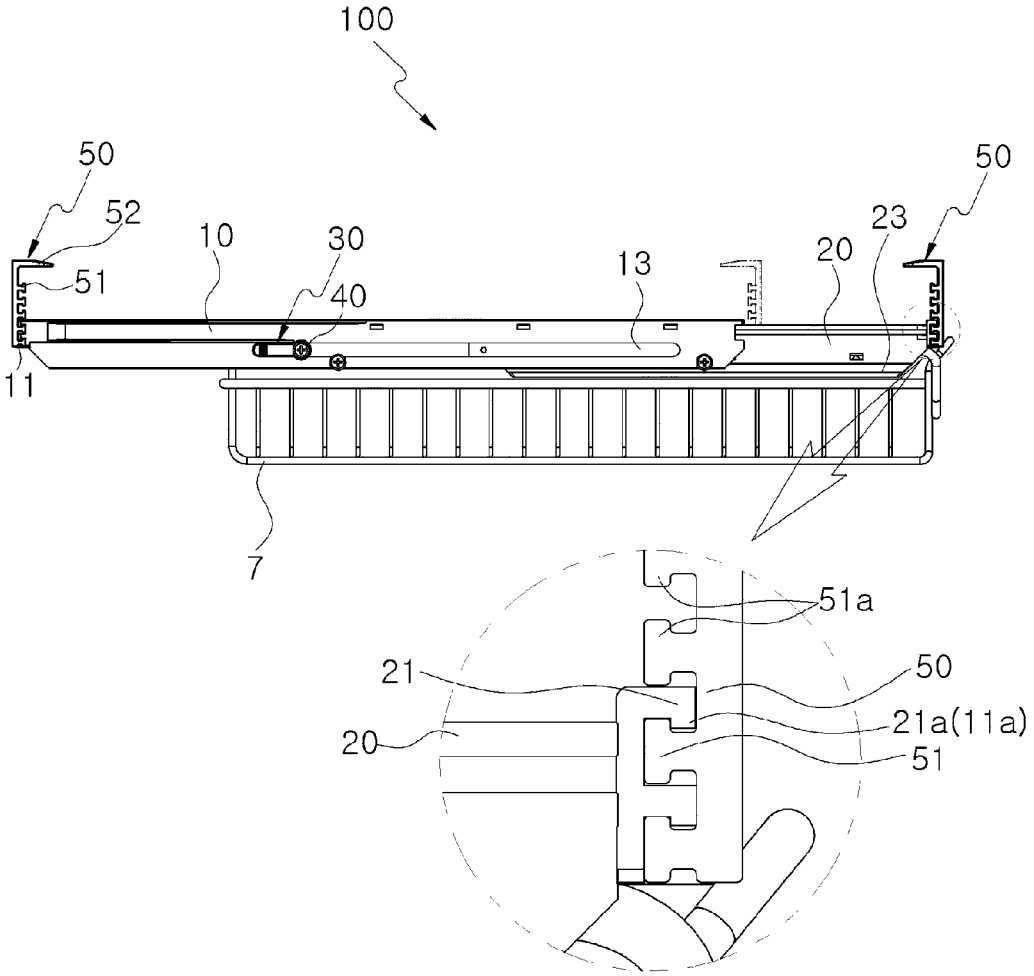
FIG. 4 is a side view showing a used state of the sliding rail according to the present invention.

Additionally, as shown in FIG. 4, the first and second concave-convex parts 11 and 21 of the fixed rail 10 and the control rail 20 form separation preventing jaws 11*a* and 21*a* which protrude from the lower portions of the front ends thereof in a convex form, and the third concave-convex part 51 of the hook means 50 forms separation preventing jaws 51*a* which protrude from both end portions of the front end of the convex shape, so that separation preventing jaws 11*a*, 21*a* and 51*a* engage with each other to be combined together more firmly during the concave-convex combination.

Therefore, in the present invention, the concave-convex part of the hook means 50 is inwardly fit to the concave-convex parts of the fixed rail 10 and the control rail 20 from the outside so as to be able to move horizontally. In this instance, because the hook means 50 may be separated if the horizontal movement is achieved excessively, hook retaining jaws 18 and 28 for retaining the horizontal movement of the hook means 50 are formed on the inner faces of the concave-convex parts of the fixed rail 10 and the control rail 20.

Accordingly, when the hook means 50 having the third concave-convex part 51 is fixed and combined to the first and second concave-convex parts 11 and 21 of the fixed rail 10 and the control rail 20 till being restricted to the hook retaining jaws 18 and 28 from the outside, the hook means 50 is not easily separated.

Additionally, because the third concave-convex part 51 formed on the inner face of the hook means 50 has the retaining hook 52 which is continuously formed in the height direction and bent at the upper portion in the direction of the shelf, the hook means 50 is concave-convexly combined to the first and second concave-convex parts 11 and 21 of the fixed rail 10 and the control rail 20 according to the thickness of the shelf 6 and the retaining hook 52 is caught to both end portions of the front and rear of the shelf 6 such that the sliding rail 100 is mounted to the shelf 6.

Furthermore, a pair of the sliding rails 100 face each other symmetrically in the opposite direction to each other, and it is preferable that an interval maintaining bar 25 be mounted on the opposed faces of the control rail 20 in a forcedly fitting manner.

The length of the interval maintaining bar 25 is regulated according to the size of the storage tray 7 assembled to the tray support 22 of the control rail 20. Additionally, the interval maintaining bar 25 has male screws or hooks formed at both end portions thereof and the control rail 20 has female screws or fixing holes formed on the inner surface thereof in correspondence with the male screws or hooks so that the interval maintaining bar 25 can be combined.

Referring to FIGS. 6 to 10, a sliding rail for mounting a shelf according to a second preferred embodiment of the present invention will be described as follows.

Figure 6:
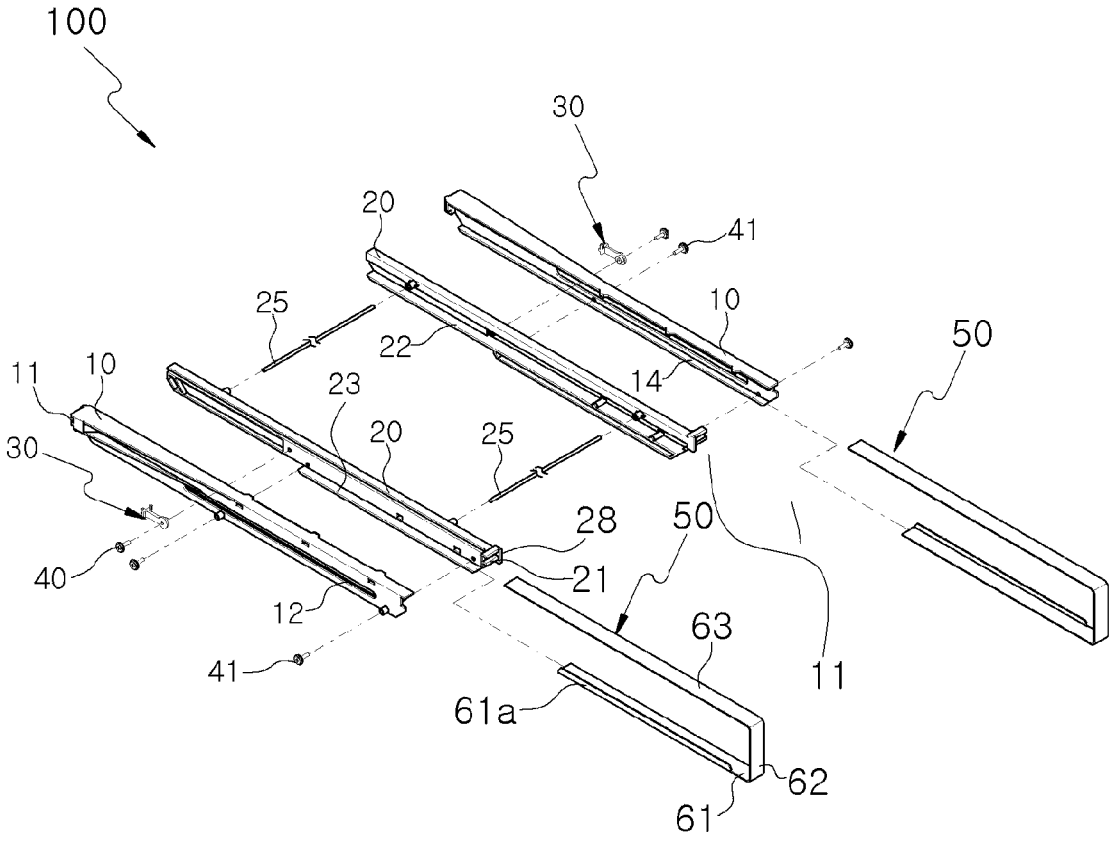
FIG. 6 is an enlarged view of a hook member of the sliding rail.
Figure 7:
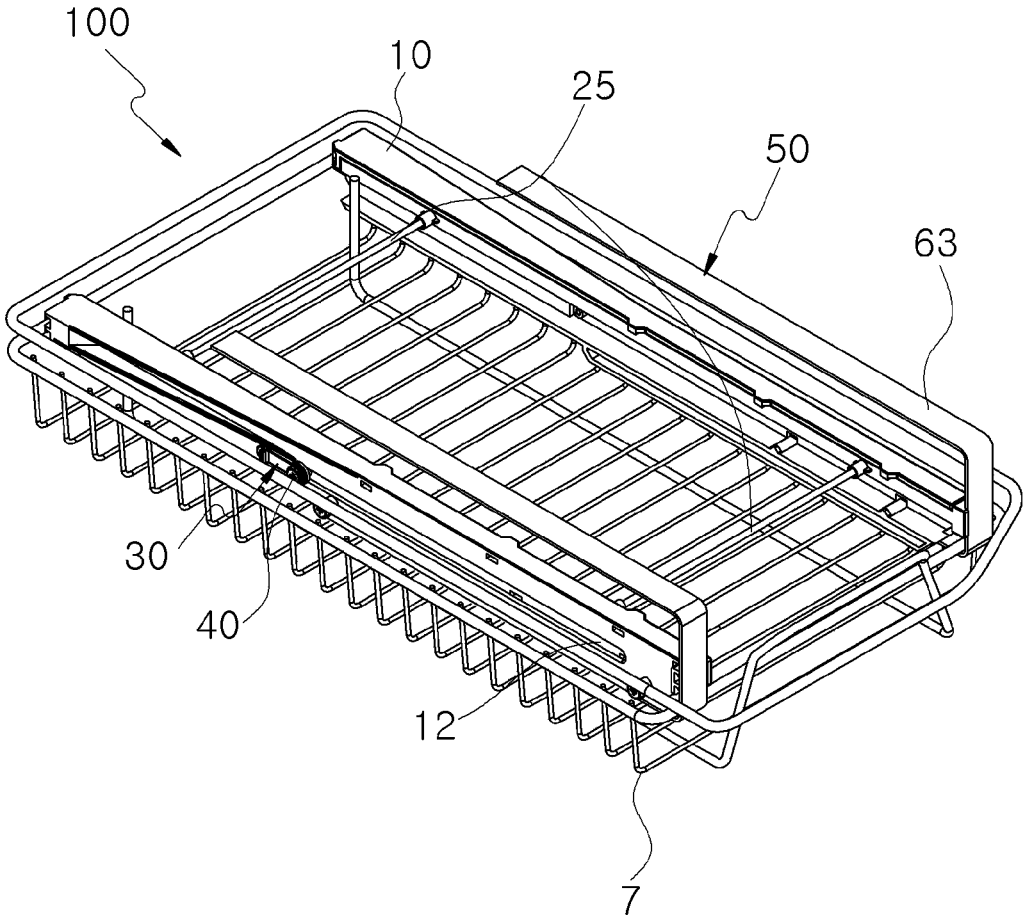
FIG. 7 is an exploded perspective view showing a sliding rail for mounting a shelf according to a second preferred embodiment of the present invention.
Figure 8:
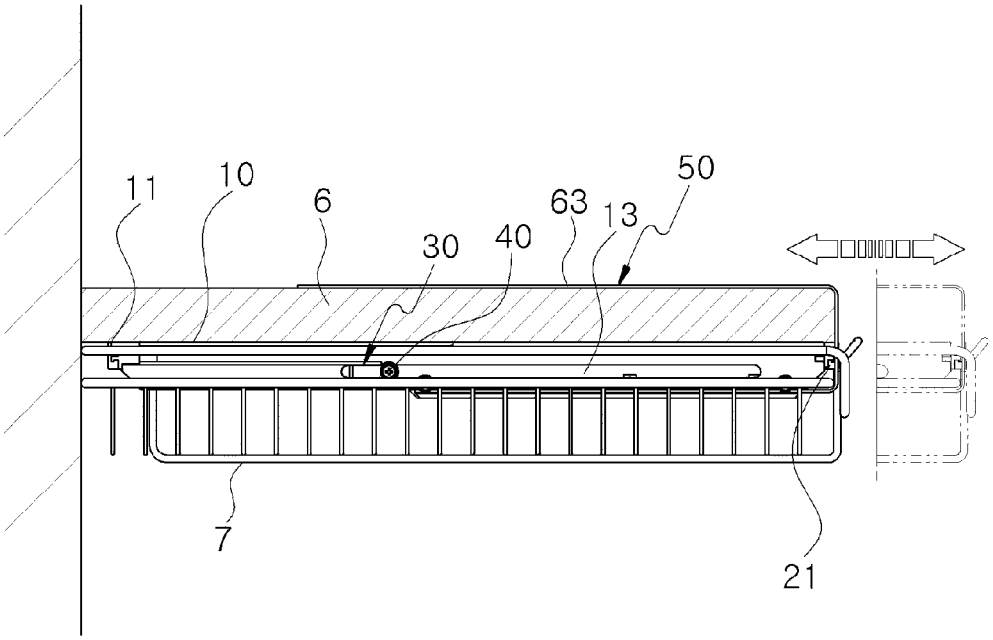
FIG. 8 is a perspective view of the sliding rail according to the second preferred embodiment of the present invention.

FIGS. 6 to 8 illustrate the sliding rail 100 applied to a shelf mounted on furniture or a refrigerator having a structure that only the front is open. Like the sliding rail according to the first preferred embodiment, the sliding rail 100 according to the second preferred embodiment includes a fixed rail 10, a control rail 20, a stopper 30 and a fastening member 40.

Here, hook means 50 is formed in a plate type and is combined to the control rail 20 in the right direction in the drawings. The hook means 50 is mounted only on one side of the shelf 6, which has a structure that only the right side is open, to be bridged.

The plate-type hook means 50 includes: a bottom plate 61 which is located below a rail support 14 of the fixed rail 10 from one end to the other end; a middle plate 62 which is continuously bent to surround the front side of a second concave-convex part 21 and the thickness of the shelf 6; and a hook plate 63 which is formed in such a way that the middle plate 62 is bent in the direction of the shelf, is longer than a guide hole 12 of the fixed rail 10 and is formed to be bridged above the shelf 6.

In this instance, the bottom plate 61 of the plate-type hook means 50 is caught to a head part of a separation preventing member 41 joined to the lower portion of the side of the fixed rail 10 so that the control rail 20 moves in a straight line without being separated to the outside when moving to be withdrawn or inserted. In another embodiment, the bottom plate 61 has a separation preventing piece 61*a* bent to surround the lower portion of the side of the fixed rail 10 and is located between the side of the fixed rail 10 and the head part of the separation preventing member 41 so as to guide the control rail 20 when the plate-type hook means 50 moves to be withdrawn or inserted.

Figure 9:
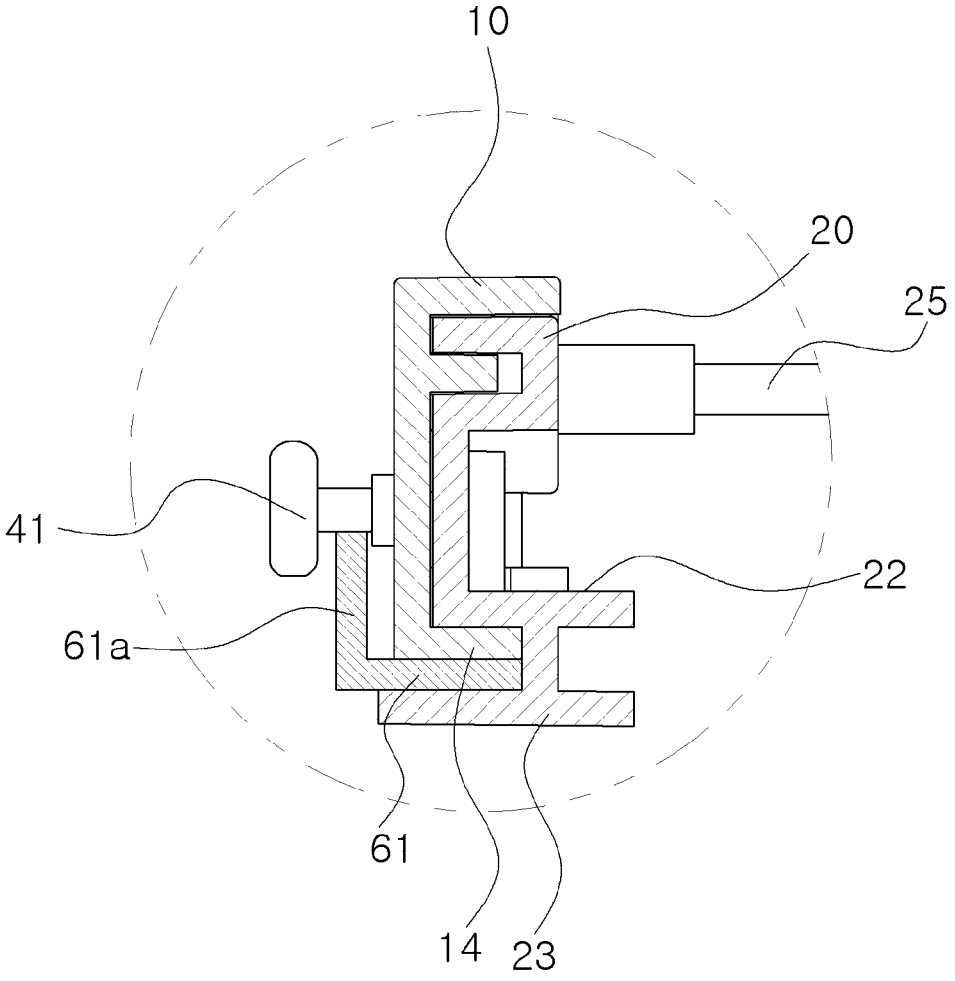
FIG. 9 is a front view showing a used state of the sliding rail according to the second preferred embodiment.

That is, as shown in FIG. 9, while the rail support 14 and the bottom plate 61 are located on the lower guide rail 23 of the tray support 22, the separation preventing piece 61*a* of the bottom plate 61 is located between the side of the fixed rail 10 and the head part of the separation preventing member 41 so that the control rail 20 and the plate-type hook means 50 are moved to be withdrawn or inserted.

Furthermore, the hook retaining jaw 28 formed on the inner face of the front face of the control rail 20 has a fixing groove (not shown) to which the middle plate 62 of the plate-type hook means 50 is inserted and fit so that the middle plate 62 is fixed to the control rail 20 while covering the front side of the second concave-convex part 21 when the plate-type hook means 50 is combined.

Additionally, because the hook plate 63 is moved to be withdrawn or inserted like the control rail 20 while being seated on the shelf 6, it is preferable that a seating part of the shelf 6 has a groove as thick as the hook plate 63 to prevent formation of a stepped portion. The hook plate 63 is formed to be longer than the guide hole 12 because the control rail 20 is withdrawn as long as the guide hole 12.

As described above, the sliding rail 100 which is mounted only on the front side of the shelf 6 using the hook plate 63 is mainly used to store relatively lightweight things. So, because the sliding rail 100 can be manufactured in a small size, the sliding rail 100 may be mounted on the shelf 6 using a plurality of the plate-type hook means 50.

Figure 10:
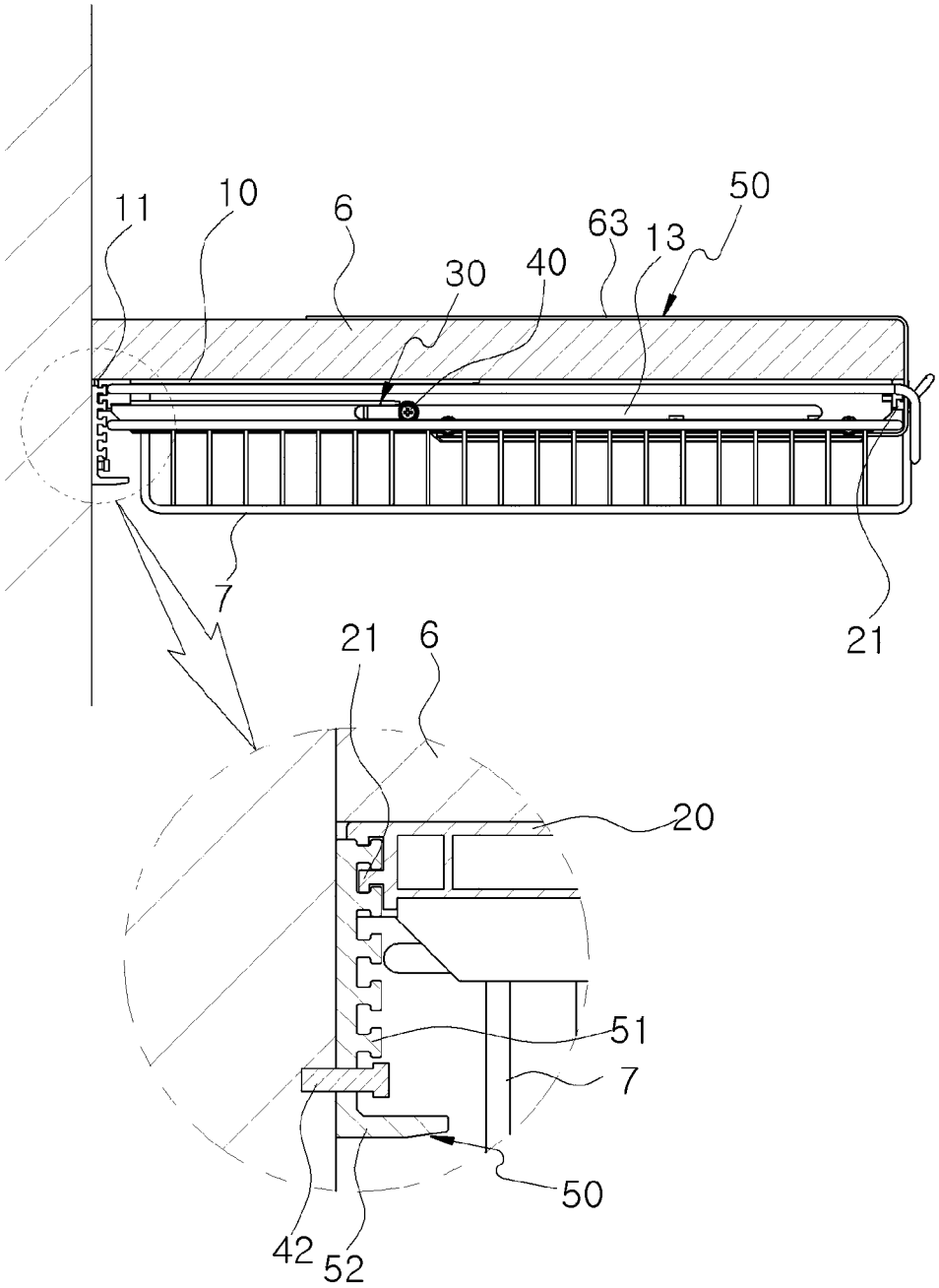
FIG. 10 is a sectional view of the sliding rail according to another preferred embodiment of the present invention.

Moreover, as shown in FIG. 10, in a further preferred embodiment of the present invention, the hook means 50 which has a retaining hook 52 located downwardly is concave-convexly combined to the rear side of the fixed rail 10, and is fastened to the wall surface of furniture by a fixing piece 42 penetrating the third concave-convex part 51 located outside the lower portion of the fixed rail 10.

Therefore, the sliding rail 100 shown in FIG. 10 allows the user to put heavy things on the storage tray 7 and guides the storage tray 7 to be withdrawn or inserted stably because the fixed rail 10 and the control rail 20 are fixed and mounted firmly, thereby enhancing competitive strength of products.

As described above, while the present invention has been particularly shown and described with reference to the preferable embodiments thereof, it will be understood by those of ordinary skill in the art that the protective scope of the present invention is not limited to the above embodiments and various changes may be made therein without departing from the technical idea of the present invention.

The invention claimed is:

1. A sliding rail for mounting a shelf and a storage tray, comprising:

a fixed rail which includes a first protrusion disposed at a rear end of the fixed rail, an elongated guide hole disposed on an outside wall of the fixed rail, a rack disposed on an upper portion of the outside wall of the fixed rail, and a rail support bent inward from the outside wall of the fixed rail;

a control rail which includes a second protrusion disposed at a front end of the control rail adjacent to a front end of the fixed rail, and a tray support disposed adjacent to the rail support such that the storage tray is supported by the tray support and the rail support;

a stopper located in the elongated guide hole, the stopper including a retaining plate disposed at one end portion thereof and having a through hole, a guide bush which protrudes from an inner face of the retaining plate and is fit into the elongated guide hole, a pressing plate disposed at another end portion thereof, and a pawl which is disposed on an inner face of the pressing plate and engages with the rack;

a fastening member which is screw-coupled to a side wall of the control rail and passes through the through hole and the guide hole to fix the pressing plate to be elastically moved in a lateral direction inside the elongated guide hole while the guide bush of the stopper moves along the elongated guide hole; and a hook means including:

a groove coupled to one of the first and second protrusions;

a bottom plate located below the fixed rail;

a middle plate extended vertically from a front end of the bottom plate to cover the front end of the control rail and a front end of the shelf; and a hook plate extended from an upper end of the middle plate toward a rear end of the control rail, wherein an extended length of the hook plate is longer than that of the elongated guide hole.

2. The sliding rail according to claim 1, wherein an interval maintaining bar is mounted on the control rail.

3. The sliding rail according to claim 1, wherein the fixed rail further includes a separation preventing member connected to a lower portion of the outside wall thereof and the bottom plate has a separation preventing piece bent upwardly from the bottom plate so that the hook means moves in a forward and backward direction together with the control rail while the separation preventing piece is located between the outside wall of the fixed rail and the separation preventing member.

4. A sliding rail for mounting a shelf and a storage tray, comprising:

a fixed rail which includes a first protrusion disposed at a rear end of the fixed rail, an elongated guide hole disposed on an outside wall of the fixed rail, a rack disposed on an upper portion of the outside wall of the fixed rail, and a rail support bent inward from the outside wall of the fixed rail;

a control rail which includes a second protrusion disposed at a front end of the control rail adjacent to a front end of the fixed rail, and a tray support disposed adjacent to the rail support such that the storage tray is supported by the tray support and the rail support;

a stopper located in the elongated guide hole, the stopper including a retaining plate disposed at one end portion thereof and having a through hole, a guide bush which protrudes from an inner face of the retaining plate and is fit into the elongated guide hole, a pressing plate disposed at another end portion thereof, and a pawl which is disposed on an inner face of the pressing plate and engages with the rack;

a fastening member which is screw-coupled to a side wall of the control rail and passes through the through hole and the elongated guide hole to fix the pressing plate to be elastically moved in a lateral direction inside the elongated guide hole while the guide bush of the stopper moves along the elongated guide hole; and a hook means including a groove coupled to one of the first and second protrusions.

5. A sliding rail for mounting a shelf and a storage tray, comprising:

a fixed rail which includes a first protrusion disposed at a rear end of the fixed rail, an elongated guide hole disposed on an outside wall of the fixed rail, a rack disposed on an upper portion of the outside wall of the fixed rail, and a rail support bent inward from the outside wall of the fixed rail;

a control rail which includes a second protrusion disposed at a front end of the control rail adjacent to a front end of the fixed rail, and a tray support disposed adjacent to the rail support such that the storage tray is supported by the tray support and the rail support;

a stopper located in the elongated guide hole, the stopper including a retaining plate disposed at one end portion thereof and having a through hole, a guide bush which protrudes from an inner face of the retaining plate and is fit into the elongated guide hole, a pressing plate disposed at another end portion thereof, and a pawl which is disposed on an inner face of the pressing plate and engages with the rack;

a fastening member which is screw-coupled to a side wall of the control rail and passes through the through hole and the elongated guide hole to fix the pressing plate to be elastically moved in a lateral direction inside the elongated guide hole while the guide bush of the stopper moves along the elongated guide hole; and a hook means including a groove coupled to one of the first and second protrusions, wherein the groove of the hook means is smaller in size than the first protrusion of the fixed rail or the second protrusion of the control rail to fix tightly the hook means to the fixed rail or the control rail.

* * * * *